US005533336A

United States Patent [19]

Kiat et al.

[11] Patent Number: 5,533,336

[45] Date of Patent: Jul. 9, 1996

[54] HYDROELECTRIC CYLINDER FOR IMPROVED POWER AMPLIFICATION AND CONTROL

[75] Inventors: Ho B. Kiat; Tan H. Choy, both of Singapore, Singapore

[73] Assignee: Advanced Systems Automation Pte Ltd, Singapore, Singapore

[21] Appl. No.: 210,307

[22] Filed: Mar. 17, 1994

[51] Int. Cl.[6] ..... F15B 7/00; B30B 1/08

[52] U.S. Cl. ..... 60/533; 91/361; 100/270

[58] Field of Search ..... 60/533, 534, 537, 60/538, 545; 91/358 R, 361; 100/269 R, 270, 48, 50; 92/132

[56] References Cited

U.S. PATENT DOCUMENTS

| | | | |
|---|---|---|---|
| 2,403,912 | 7/1946 | Doll | 60/538 |
| 2,587,571 | 2/1952 | Lombard | 60/538 |
| 3,095,190 | 6/1963 | Freund | 100/270 |
| 3,595,163 | 7/1971 | Baumann | 100/270 |
| 4,896,594 | 1/1990 | Baur et al. | 100/269 R |
| 4,898,082 | 2/1990 | Pottorff | 92/132 |
| 5,031,506 | 7/1991 | Baisch et al. | 51/363 R |
| 5,140,895 | 8/1992 | Imanishi | 100/269 R X |
| 5,253,572 | 10/1993 | Uehara et al. | 100/48 |

FOREIGN PATENT DOCUMENTS

| | | | |
|---|---|---|---|
| 3505934 | 8/1986 | Germany | 100/270 |

*Primary Examiner*—Hoang Nguyen
*Attorney, Agent, or Firm*—Lawrence Y. D. Ho

[57] ABSTRACT

The present invention describes an apparatus for achieving power amplification in general press and elevating systems with enhanced control and without the disadvantages of the pneumatic and angle-linked devices. A motor is coupled to a screw and nut for delivering force to at least one transfer piston within a fixed volume at the base of a larger piston. Amplification of power is attained when transfer piston displaces the fluid within the fixed volume. A pressure sensor in the fixed volume and coupled to the motor provides the closed loop feedback required of the control of power amplification. The change in force exerted by the transfer piston has linear relationship with the change in power output of the larger piston.

8 Claims, 5 Drawing Sheets

HYDROELECTRIC CYLINDER FOR IMPROVED POWER AMPLIFICATION AND CONTROL

BACKGROUND OF THE INVENTION

1. Field of the Invention

The present invention relates to a method and apparatus for achieving power amplification in general press and elevating systems with enhanced control.

2. Description of the Related Art

Pneumatic and angle-linked devices are commonly used in amplifying general press application and elevating system. With respect to pneumatic devices, air pressure is applied by a small cylinder over a closed channel connected to a bigger cylinder where the output pressure is multiplied. Such a device has minimal moving parts and is suitable for clean room applications. However, pneumatic devices are vulnerable to fluctuation at the air inlet. Independent air compressors are coupled to such pneumatic devices to compensate for inconsistent supply of air pressure. Such remedial measures are contrary to the requirements of a clean room environment.

Angle-linked devices are economical. The toggle mechanism in such devices relies on the principles of mechanical advantage. It follows that the output from the servo motor is used as an input to the plurality of linkages and joints. The disadvantage of the toggle mechanism lies in the disproportionate amplification of the input to the linkages and joints. As such, the mechanical linkage and joints are subjected to premature wear and tear. Furthermore, angle-linked devices require more energy to operate than the others as the toggle assembly has to move in unison along the center axis of the screw drive.

SUMMARY OF THE INVENTION

The present invention describes a method and apparatus for achieving power amplification in general press and elevating systems with enhanced control and without the disadvantages of the pneumatic and angle-linked devices. A motor is coupled to a screw and nut for delivering force to at least one transfer piston within a fixed volume at the base of a larger piston. Amplification of power is attained when transfer piston displaces the fluid within the fixed volume. A pressure sensor in the fixed volume and coupled to the motor provides the closed loop feedback required of the control of power amplification. The change in force exerted by the transfer piston has linear relationship with the change in power output of the larger piston.

DETAILED DESCRIPTION OF THE INVENTION

An apparatus for achieving power amplification in general press and elevating systems with enhanced control is described. In the following description, numerous specific details of a hydroelectric press such as transfer pistons and seals, etc. are described in order to provide a thorough understanding of the present invention. It will be obvious to one skilled in the art that the present invention may be practiced without these specific details. In other instances, well-known parts of general press such as those involved with the transfer platen and plunger are not shown in order not to obscure the present invention.

Figure 1:
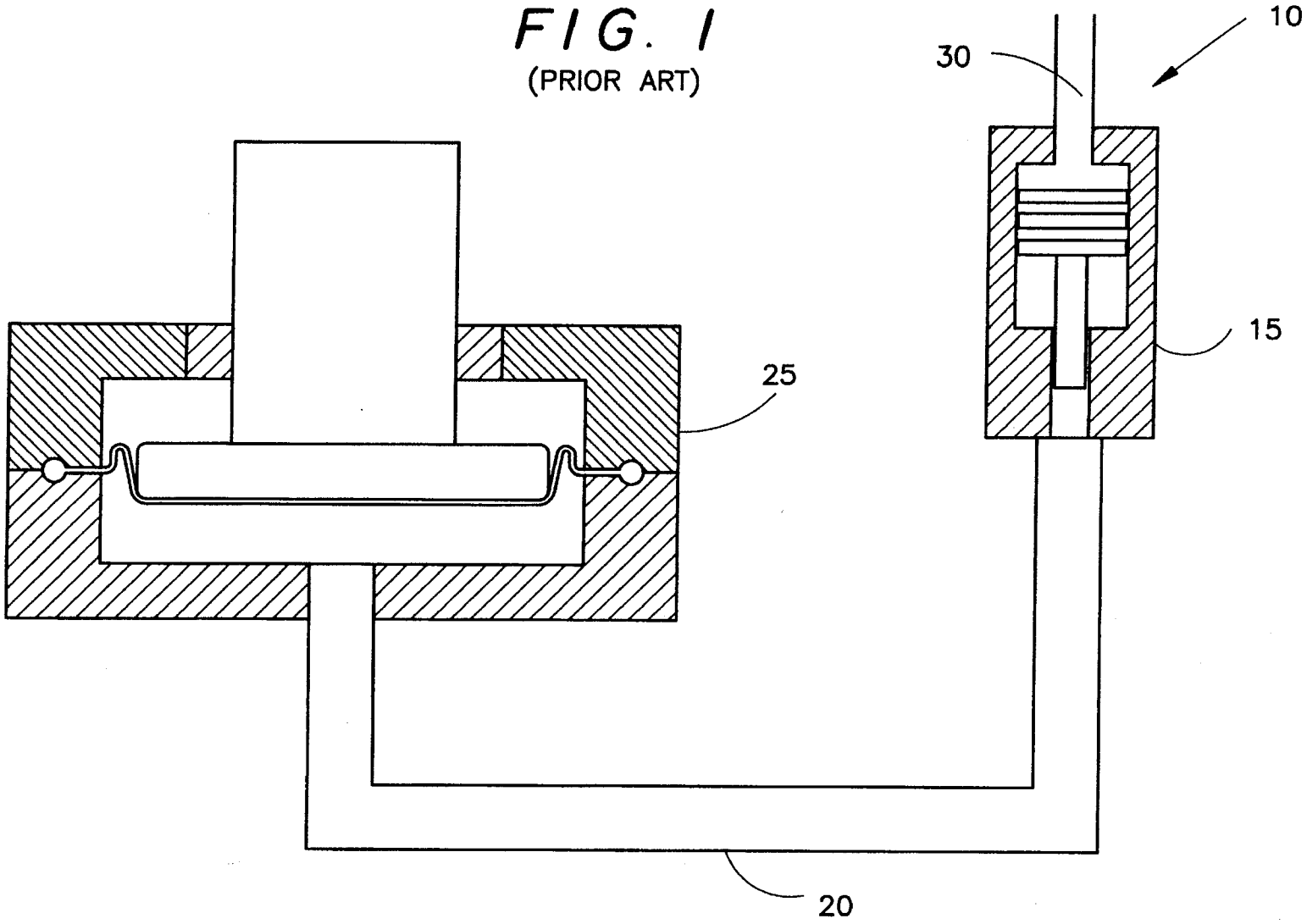
FIG. 1 (PRIOR ART)
FIG. 1. is a front, cross section elevational view of a prior art hydro-pneumatic cylinder.
Figures 7A, 7B, 7C:
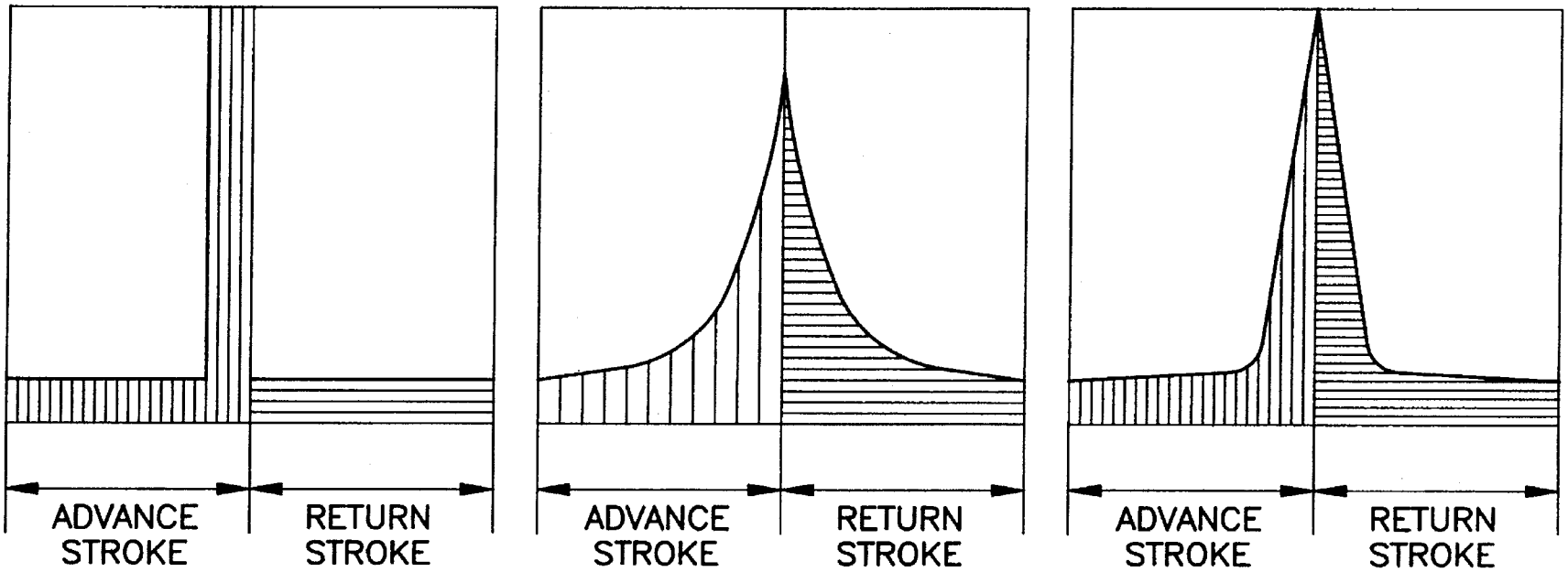
FIG. 7A is a graph of the power output during the advance stroke and return stroke of a hydro-pneumatic press.
FIG. 7B is a graph of the power output during the advance stroke and return stroke of a toggle joint press.
FIG. 7C is a graph of the power output during the advance stroke and return stroke of the present invention.

FIG. 1. is a front, cross section elevational view of a prior art hydro pneumatic cylinder. The pneumatic cylinder 10 comprises at least one small cylinder 15 and at leastone larger cylinder 25 and an enclosed channel 20 connecting both cylinders. The small cylinder 15 is coupled to a supply of a column of air 30. Disposed within the enclosed channel 20 is fluid for transferring pressure exerted by the air column 30 on the small cylinder 15. It should be understood by one skilled in the art that the output at the larger cylinder 25 is amplified provided that there is no leakage in the enclosed channel 20. FIG. 7A is a graph of the power output during the advance stroke and return stroke of a hydro-pneumatic press. As mentioned above, pneumatic devices have minimal moving parts and suitable for clean room applications. However, pneumatic devices are vulnerable to fluctuation at the air inlet. Independent air compressors are coupled to such pneumatic devices to compensate for inconsistent supply of air pressure. Such remedial measures are contrary to the requirements of a clean room environment.

Figure 2:
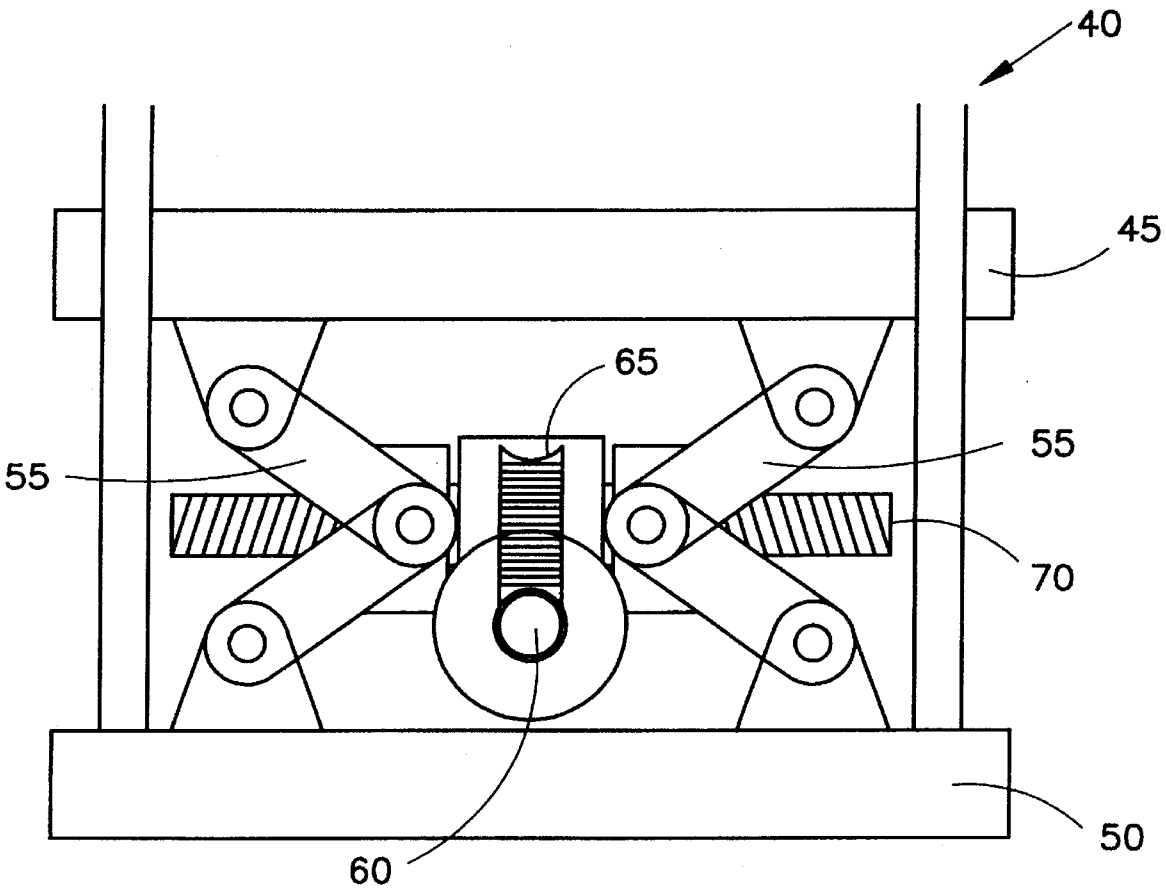
FIG. 2 (PRIOR ART)
FIG. 2. is a front, cross section elevational view of a prior art angle-linked device.

FIG. 2. is a front, cross section elevational view of a prior art angle-linked device. Angle-linked devices are also known as toggle presses. The angle-linked device 40 comprises at least a platform 45 supported by a base 50 and a plurality of mechanical linkages 55. The linkage 55 is further coupled to a worm 60, gear 65 and screw 70. The toggle assembly in the angle-linked device 40 rely on the principles of mechanical advantage. It follows that the output from the servo motor (not shown) is used as an input to the plurality of linkages and joints. FIG. 7B is a graph of the power output during the advance stroke and return stroke of a toggle joint press. The disadvantage of the toggle mechanism lies in the disproportionate amplification of the input to the linkages and joints. Proper assembly of angle-linked devices requires the matching of linkages of equal tolerance. Otherwise the mechanical linkage and joints are subjected to premature wear and tear. Furthermore, angle-linked devices require more energy to operate than the others as the toggle assembly has to move in unison along the center axis of the screw drive.

Figure 3:
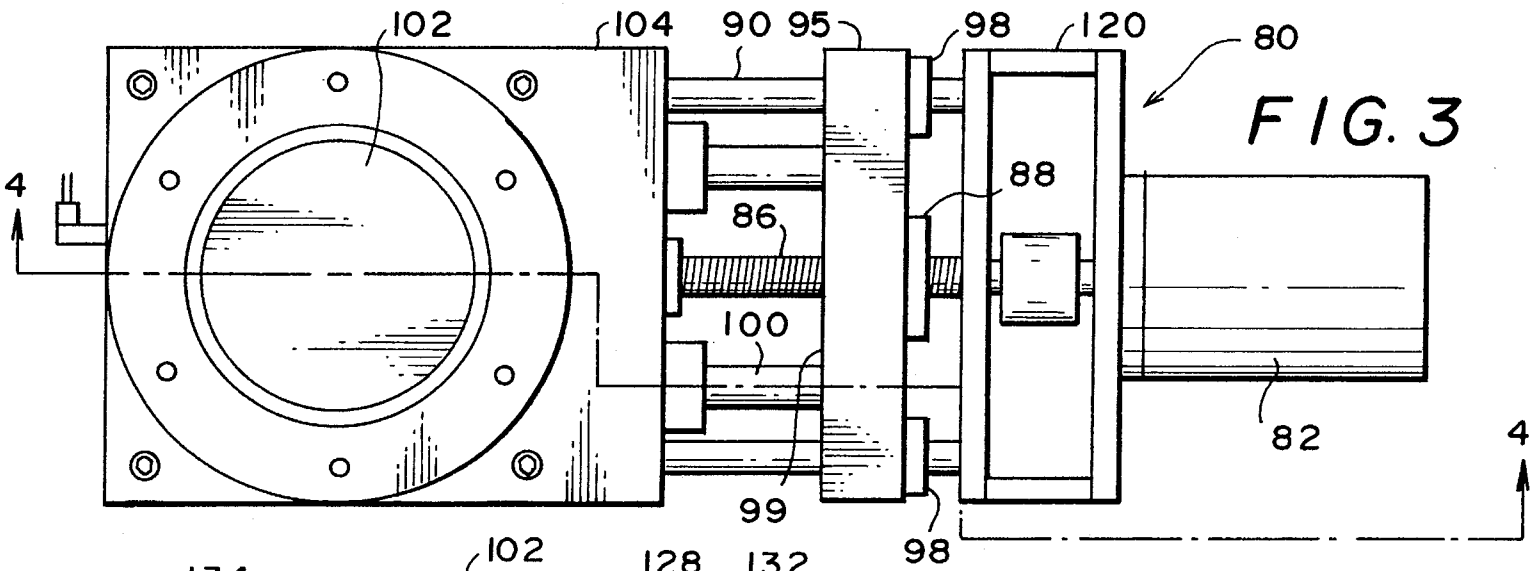
FIG. 3. is a top plan elevational view of a first embodiment of the present invention.

FIG. 3. is a top plan elevational view of a first embodiment of the present invention. A single acting hydro-electric cylinder 80 comprises at least one motor 82, at least one screw 86, at least one nut 88, a plurality of guide rods 90, at least one transfer rod plate 95, at least one transfer piston 100, and a main piston 102. The motor is preferably an electric motor and its drive shaft (not shown in FIG. 3) is coupled concentrically to the screw 86 for delivering rotational movement along the longitudinal axis of the screw. The screw is preferably a planetary roller screw or substitute thereof. The nut 88 is preferably a roller nut or substitute thereof whose inner surface is coupled concentrically to the threaded surface of the screw 86. The screw 86 is supported at one end by bearings (not shown in FIG. 3) in main housing 104 of the piston 100. The other end of the screw 86 is supported similarly by bearings (not shown in FIG. 3) in an auxiliary housing 120. It should be understood by one skilled in the art that the auxiliary housing 120 is attached fixedly to the main housing 104. Disposed between the main housing 104 and the auxiliary housing 120 are the guide rods 90. These guide rods are aligned in parallel with the longitudinal axis of the screw 86 and are attached fixedly at one end to the main housing 104 and at the other end to the auxiliary housing 120. The guide rods 90 are used for guiding the transfer rod plate 95. The transfer rod plate 95 is coupled slidably in the center to the nut 88; at its peripheral are guide openings 97 (not shown in FIG. 3) featuring guide bush 98 for receiving and guiding the guide rods 90. The side wall 99 of the transfer rod plate is orthogonal to the longitudinal axis of the guide rods 90. As such, the transfer rod plate 95 moves in a precise and controlled manner along the longitudinal axis of the guide rod as the motor 82 engages the screw 86.

Referring again to FIG. 3, one end of the transfer piston 100 is flushed against the side wall 99 of the transfer rod plate. The other end of the piston are disposed within the fixed volume of hydraulic fluid 108 at the base of the main housing 104. The transfer piston 100 is aligned in parallel with the longitudinal axis of the guide rod 90. The nut 88 attached to the transfer rod plate 95 translates the rotational movement of the motor-screw assembly into linear movement of the transfer rod plate along the longitudinal axis of the guide rod 90. The side wall of the transfer rod plate exerts pressure on the transfer piston 100.

Figure 4:
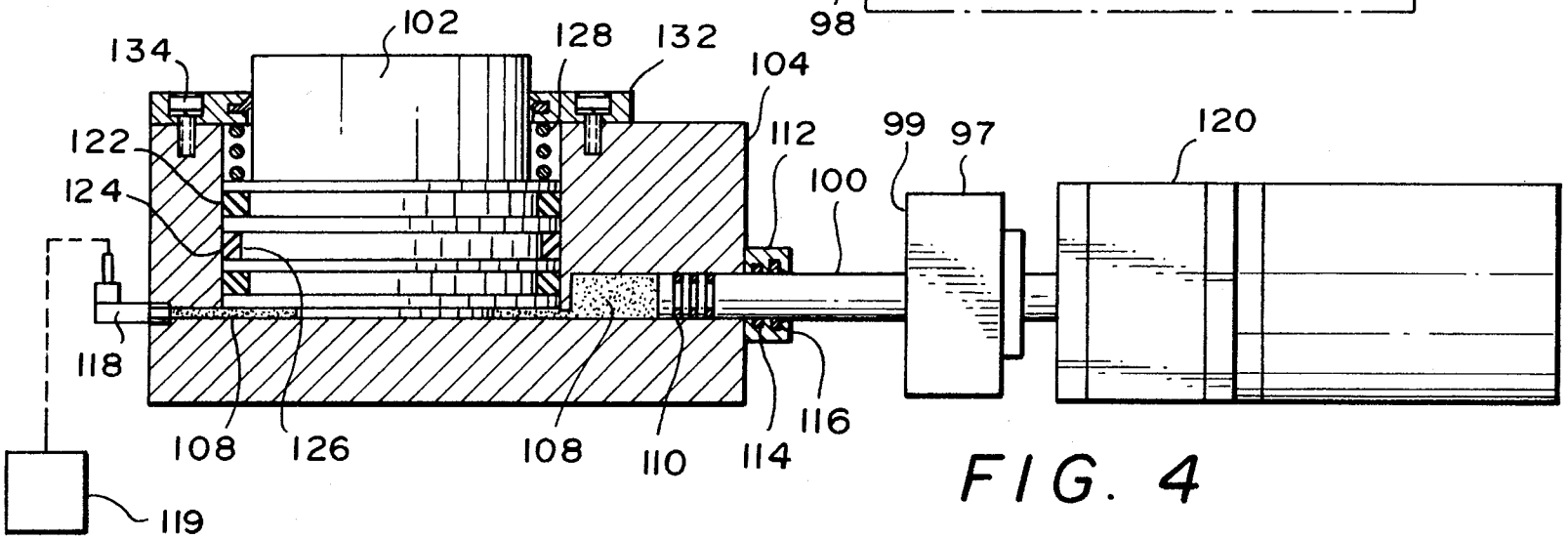
FIG. 4. is a left side, cross section elevational view of the first embodiment of the present invention according to line 4—4 in FIG. 3.

FIG. 4. is a left side, cross section elevational view of the first embodiment of the present invention according to line 4—4 in FIG. 3. The main housing 104 and the auxiliary housing 120 are integrated structurally. It should be evident to one skilled in the art that the rotational movement of the motor 82 and the linear movement of transfer piston 100 are aligned along the same longitudinal axis. As such, minimum movement parts are required. Furthermore, In contact with fluid 108, the other end of the transfer piston moves the column of fluid 108 and exerts pressure on the main piston 102. The end of the transfer piston being enclosed within the main housing 104 has at least one seal ring 110 to prevent fluid leakage. A seal flange 112 coupled to the side wall closer to the motor is used for capping the transfer piston. Disposed concentrically within the seal flange 112 are another seal ring 114 and seal wiper 116 for sealing the fixed volume. Referring again to FIG. 4, at least one pressure sensor 118 caps the other opening of the fixed volume.

The sensor 118 is coupled (not shown in FIG. 4) to the motor over a simple pressure feedback system for providing closed loop signals thereto. A typical feedback system 119 using servo-motor comprises at least one analog-to-digital (A/D) converter, a programmable logic controller and a amplifier. While the pressure sensor 118 is coupled to the A/D converter for converting pressure signals into current/voltage signals, the programmable logic controller is coupled to the A/D converter for receiving current/voltage signals therefrom. It should be understood that the programmable logic controller is further coupled at its input to a computer for receiving commands thereform. At its output, the programmable logic controller is coupled to an amplifier for transmitting controlled signals thereto. Finally, the output of the amplifier is coupled to the input of the motor 82. The programmable logic controller used in the present invention is a servo motor controller NT 40 manufacturer by Phase-E. The amplifier is a driver DIMA 2-20 manufactured by Jetter.

As the fixed volume 106, the pressure sensor 118, the pressure feedback system, the transfer piston 100, the screw 86 and the motor 82 forms a closed system, the signals transmitted from the pressure sensor 118 comprise closed loop feedback signals. The column of fluid 108 exerts amplified pressure on the main piston 102. Just as the transfer piston, seal rings 122 and 124 are fitted on the piston 102 to prevent fluid leakage. At least one wear ring is also fitted onto the piston for aligning the main piston 102. On the annulus end of the main piston 102 a seal flange 132 attached fixedly with bolts 134 to the top of the main housing 104 for capping the piston 102. Beneath the seal flange is at least a spring 128 for returning the piston to its original position after it has done its work.

It follows from the description of FIGS. 3 and 4, the first embodiment of the present invention offers a reliable cylinder for high force amplification with minimum moving parts. The amplification of force or pressure occurs within a fixed volume having minimum connections such as piping and hose attachments with the external motor. Structurally, the present invention is compact. Furthermore, the common problem of fluid leakage in conventional hydraulic system is obviated. Thus, the present invention is suitable but not exclusively for clean room manufacturing environment.

Referring again to FIGS. 3 and 4, control of the amplified force is accomplished by the feedback provided by the pressure sensor which is coupled to the motor. As the main piston, transfer piston, the fixed volume and fluid disposed therein comprises a closed system, any change in force exerted by the transfer piston corresponds to linear change in the pressure exerted on the fluid which again corresponds to a linear change in the final force produced by the main piston. Thus, the present invention offer superior control by virtue of the linear relationship between motor torque and output pressure. FIG. 7C is a graph of the power output during the advance stroke and return stroke of the present invention. On the vertical axis is the torque output of the present invention. On the horizontal axis is time. Note the relationship between the torque output of the present invention and time is linear after the approach force has being exerted on the present invention. The approach force is the force exerted on the piston by linkages coupled to the cylinder; it should be understood by one skilled in the art that the servo controller activates the motor only after the approach force has been exerted. The linear relationship is maintained not only on the advance but also the return stroke. In contrast, the idealized power output profiles of prior art presses as exemplified in FIGS. 7A and 7B are non-linear. As such, control of the torque output of prior art presses is difficult at best. Furthermore, prior art hydro-pneumatic devices suffers from fluctuation in air pressure. Similarly, the present invention also avoid the premature wear and tear problem encountered in angle-linked or toggle devices as a result of slight misalignment of the links.

Figure 5:
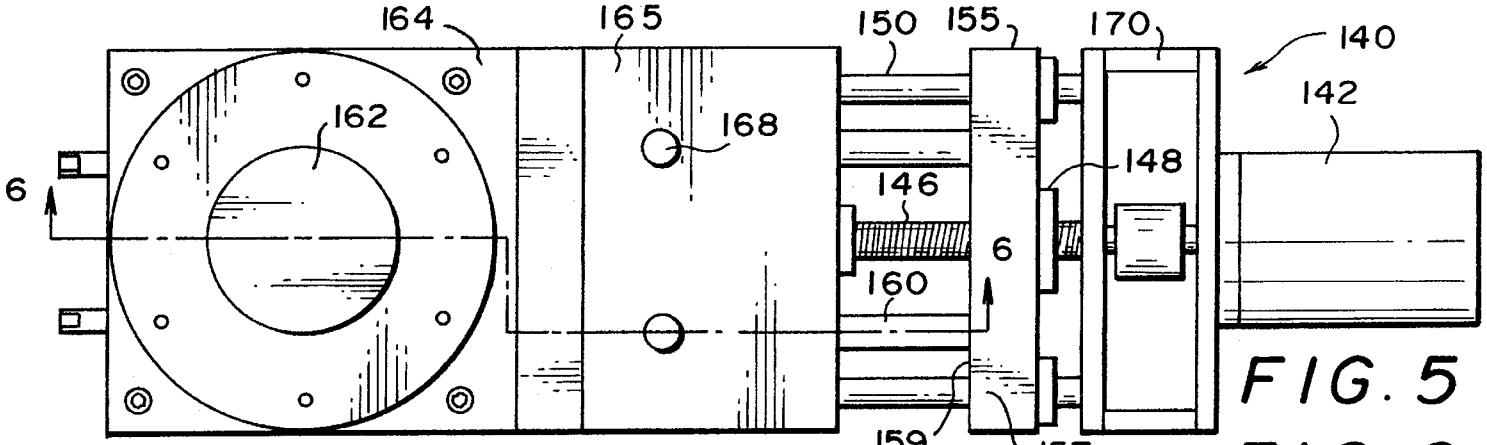
FIG. 5. is a top, plan elevational view of a second embodiment of the present invention.

FIG. 5. is a top, plan elevational view of a second embodiment of the present invention. A double acting hydro-electric cylinder 140 comprises at least one motor 142, at least one screw 146, at least one nut 148, at least one guide rod 150, at least one transfer rod plate 155, at least one transfer piston 160, and a main piston 162. The motor is preferably an electric motor and its drive shaft (not shown in FIG. 5) is coupled concentrically to the screw 146 for delivering rotational movement along the longitudinal axis of the screw. The screw is preferably a planetary roller screw or substitute thereof. The nut 148 is preferably a roller nut or substitute thereof whose inner surface is coupled concentrically to the threaded surface of the screw 146. The screw 146 is supported at one end by bearings (not shown in FIG. 5) in main housing 164 of the piston 162. The other end of the screw 146 is supported similarly by bearings (not shown in FIG. 5) in an auxiliary housing 170. It should be understood by one skilled in the art that the auxiliary housing 170 is attached fixedly to the main housing 164. At least one accumulator 168 is disposed on the top surface of the main housing 164. The function of the accumulator shall be elaborated in connection with the description of the second embodiment of the present invention in FIG. 6. Disposed between the main housing 164 and the auxiliary housing 170 are the guide rods 150. These guide rods are aligned in parallel with the longitudinal axis of the screw 146 and are attached fixedly at one end to the main housing 164 and at the other end to the auxiliary housing 170. The guide rods 150 are used for guiding the transfer rod plate 155. The transfer rod plate is coupled slidably in the center to the nut 148; at its peripheral are guide openings 157 (not shown in FIG. 5) featuring guide bush 158 for receiving and guiding the guide rods 150. The side wall 159 of the transfer rod plate is orthogonal to the longitudinal axis of the guide rods 150. As such, the transfer rod plate 155 moves in a precise and controlled manner along the longitudinal axis of the guide rod as the motor 142 engages the screw 146.

Referring again to FIG. 5, one end of the transfer piston 160 is flushed against the side wall 159 of the transfer rod plate. The other end of the piston is disposed within the fixed volume 166 at the base of the main housing 164. The transfer piston 160 is aligned in parallel with the longitudinal axis of the guide rods 150. The nut 148 attached to the transfer rod plate 155 translates the rotational movement of the motor-screw assembly into linear movement of the transfer rod plate along the longitudinal axis of the guide rods 150. The side wall of the transfer rod plate exerts pressure on the transfer piston 160.

Figure 6:
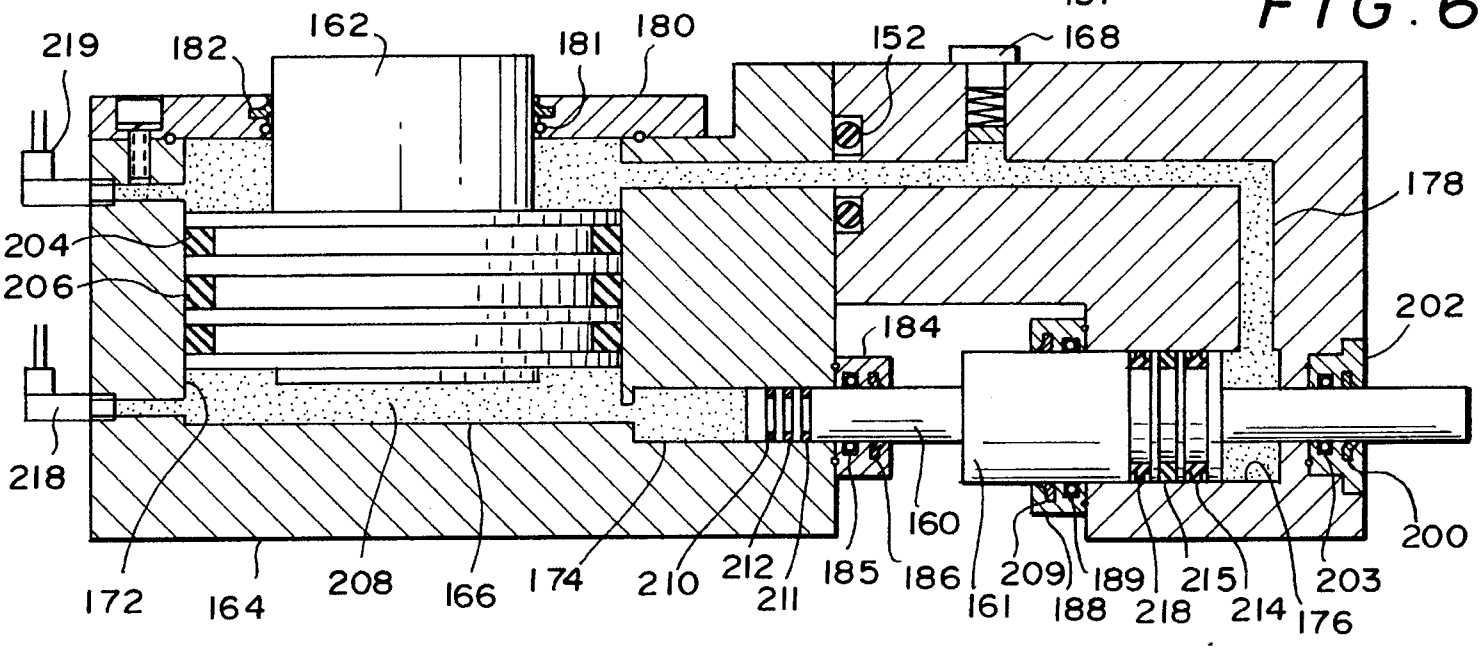
FIG. 6. is a left side, cross section elevational view of the second embodiment of the present invention according to line 6—6 in FIG. 5.

FIG. 6. is a left side, cross section elevational view of the second embodiment of the present invention according to line 6—6 in FIG. 5. The main housing 164 and a housing attachment 165 are integrated structurally over housing seals 152. The seals are used to prevent any leakage of fluid from a feedback channel 178. The main housing 164 features at least one main piston bore 172 for receiving the main piston 162. Moreover, at least one transfer piston bore 174 is made horizontally to receive one end of the transfer piston 160. The fixed volume 166 thus comprises the volume bounded by the bores 172 and 174 as well as the pistons 160 and 162. The fixed volume is sealed by capping the main piston 162 with a seal flange 180 and the transfer piston 160 with a seal flange 184. The seal flange 180 is reinforced with at least a seal ring 181 and seal wiper 182, the seal flange 184 with seal ring 185 and seal wiper 186. The main piston 162 also has main piston seal rings 204 and 205 for preventing the leakage of fluid from the fixed volume 166. There is also a main piston wear ring 206 for aligning the main piston within the main piston bore. Likewise, the transfer piston features transfer piston seal rings 210 and 211 for minimizing risk of any fluid leakage from the fixed volume 166. Disposed between the seal rings is at least one wear ring for aligning the transfer piston.

In contrast with the first embodiment of the present invention, the second embodiment of the present invention in FIG. 6 has a feedback channel 178 connecting the annulus side of the main piston with that of the transfer piston. The feedback channel is a bore 178 in the housing attachment 165 and terminates in a transfer piston bore 176. The transfer piston bore receives an intermediate piston 161. It should be understood by one skilled in the art that the transfer piston 160 and the intermediate piston 161 is integrated as one piston. The feedback channel 178 is sealed by capping the intermediate piston 161 with a seal flanges 188 and 202. The seal flanges 188 and 202 incorporates seal rings 189 and 203 for preventing any fluid leakage from the feedback channel respectively. The flanges also features wiper rings 200 and 209 for removing dust and fluid during piston movement. The transfer piston 161 also features wear rings 212 and 215 for aligning the transfer piston within the transfer piston bores 174 and 176 respectively. There are at least two pressure sensors 218 and 219 in communication with the fixed volume 166 and the feedback channel 178 respectively. The sensor 218 is coupled to the motor 142 (not shown in FIG. 6) over a simple pressure feedback system similar to that for the first embodiment of the present invention for transmitting feedback signals thereto.

Referring again to FIG. 6, the transfer piston 160 moves the column of fluids 208 within the fixed volume 166 and exerts an amplified force on the main piston 162 in response to forward movement of the motor (not shown in FIG. 6). On the annulus side of the main piston, fluids in the feedback channel 178 is moved towards the annulus side of the intermediate transfer piston 161. In the case of a double acting cylinder, the return stroke for the main piston 162 is activated by exerting a reverse motor torque of the motor 142 (shown in FIG. 5). Fluid then flows from the annulus side of the intermediate transfer piston 161 via the feedback channel 178 back to the annulus side of the main piston 162. Note that it is important for the fluids in the fixed volume 166 and that in the feedback channel 178 to have the same volume before the double acting feature of the second embodiment of the present invention performs as expected. The accumulator 168 compensates for any slight area differential of the pistons 161 and 162, thus obviating any uneven transfer of piston movement.

The sensors 218 and 219 are coupled (not shown in FIG. 6) to the motor for providing feedback signals thereto. The fixed volume 166, the pressure sensor 218, the pressure feedback system (not shown in FIG. 6), the transfer piston 160, and the screw 146 forms one closed system. On the other hand, the pressure sensor 219 functions as a switch by responding to a predetermined pressure threshold. Once this pressure threshold is reached, the motor 142 shuts down. As such, the pressure in the feedback channel 178 replaces the spring 128 in the first embodiment of the present invention.

It follows from the description of FIGS. 5 and 6, the second embodiment of the present invention offers a reliable cylinder for high force amplification with minimal moving parts. The amplification of force or pressure occurs within two closed volume having minimal connections such as piping and hose attachments with the external motor. Structurally, the present invention is compact. The double-acting piston and the feedback channel replaces the spring and thus having minimum moving part. Functionally, the second embodiment is also versatile. Furthermore, the common problem of fluid leakage in conventional hydraulic system is obviated. Thus, the present invention is suitable but not exclusively for clean room manufacturing environment.

While the present invention has been described particularly with reference to FIGS. 1 to 7C with emphasis on an apparatus for achieving power amplification in general press and elevating systems with enhanced control, it should be understood that the figures are for illustration only and should not be taken a limitation on the invention. In addition, it is clear that the apparatus of the present invention has utility in many applications where general press application and elevation requirement are required. It is contemplated that many changes and modifications may be made by one of ordinary skill in the art without departing from the spirit and the scope of the invention as described.

We claim:

1. In a press for achieving enhanced control in power amplification including a computer, a programmable logic control, a servo motor controller, and at least a driver, said servo motor controller being coupled to said computer and said programmable logic control respectively, said servo motor controller being further coupled to said driver, said press comprising:

a cylinder having a first piston disposed therein, one end of said piston terminating in a fixed volume of hydraulic fluid, the other end of said piston terminating in a spring;

a motor coupled to a screw and nut for delivering force to at least a second piston disposed within said fixed volume; and a sensor coupled to said fixed volume and said programmable logic control for delivering linear drive on the advance and return stroke of said first piston respectively.

2. A press according to claim 1 wherein said first piston has a radius that is larger than that of said at least one second piston.

3. A press according to claim 1 wherein said sensor transmits signals corresponding to a pressure of the enclosed hydraulic fluid acting on said first piston.

4. A press according to claim 1 wherein said programmable logic control maintains constant amplification of output of said first piston after an approach force is applied.

5. In a press for achieving enhanced control in power amplification including a computer, a programmable logic control, a servo motor controller, and at least a driver, said servo motor controller being coupled to said computer and said programmable logic control respectively, said servo motor controller being further coupled to said driver, said press comprising:

a cylinder having a first piston disposed therein, one end of said piston terminating in a fixed volume, the other end of said piston terminating in a feedback channel;

a motor coupled to a screw and nut for delivering force to at least a second piston, one end of said second piston terminating within said fixed volume, the other end of said second piston terminating within said feedback channel;

a first sensor coupled to said feedback channel and said programmable logic control for shutting down said motor upon reaching a predetermined pressure threshold; and a sensor coupled to said fixed volume and said programmable logic control for delivering linear drive on the advance and return stoke of said first piston respectively.

6. A press according to claim 5 wherein said first piston has a radius that is larger than that of said second piston.

7. A press according to claim 5 wherein said sensor transmits signals corresponding to a pressure of the enclosed hydraulic fluid acting on said first piston.

8. A press according to claim 5 wherein said programmable logic control maintains constant amplification of output of said first piston after a fast approach force is applied.

* * * * *